United States Patent [19]

Donenfeld et al.

[11] Patent Number: 5,008,239

[45] Date of Patent: Apr. 16, 1991

[54] TRANSFER PRINTING OF NATURAL AND NATURAL/SYNTHETIC FIBRES

[75] Inventors: Henry Donenfeld, Brighton; Eduard Lemanis, East Keilor, both of Australia

[73] Assignee: BASF Australia Ltd., Melbourne, Australia

[21] Appl. No.: 235,041

[22] Filed: Aug. 22, 1988

[30] Foreign Application Priority Data

Aug. 21, 1987 [AU] Australia ..... P13886

[51] Int. Cl.[5] ..... B41M 5/035; B41M 5/26

[52] U.S. Cl. ..... 503/227; 8/471; 428/195; 428/201; 428/206; 428/327; 428/913; 428/914

[58] Field of Search ..... 8/471; 428/195, 913, 428/914, 327, 201, 206; 503/227

[56] References Cited

U.S. PATENT DOCUMENTS 4,093,415 6/1978 Defago et al. ..... 8/471
4,541,830 9/1985 Hotta et al. ..... 8/471

FOREIGN PATENT DOCUMENTS 168757 10/1981 Australia ..... 8/471
1175090 8/1986 Japan ..... 503/227

*Primary Examiner*—Bruce H. Hess
*Attorney, Agent, or Firm*—Irell & Manella

[57] ABSTRACT

A method of transfer printing natural or natural/synthetic blend fibres without pretreatment thereof is provided which comprises applying to a temporary support e.g. a paper sheet or roll a disperse dyestuff and an aqueous dispersion of a transfer agent selected from the group consisting of:

(1) polyurethane powders, with or without curing agents;
(2) polyester or copolyester powders, with or without curing agents;
(3) polyamide and copolyamide powders; and
(4) mixtures thereof, drying said support and transfer printing said support in a manner known in the art.

Also provided is a method of printing and/or coating a temporary support e.g. a paper sheet or roll for use in transfer printing of natural or natural/synthetic blend fibres without pretreatment thereof which comprises printing and/or coating said support with a disperse dyestuff and an aqueous dispersion of a transfer agent selected from the group consisting of:

(1) polyurethane powders, with or without curing agents;
(2) copolyester powders, with or without curing agents;
(3) polyamide and copolyamide powders; and
(4) mixtures thereof, and drying said support.

25 Claims, No Drawings

TRANSFER PRINTING OF NATURAL AND NATURAL/SYNTHETIC FIBRES

This invention relates to the transfer printing of natural and natural/synthetic blend fibres without pretreatment thereof.

In order to enable the utilization of transfer printing techniques in relation to natural or natural/ synthetic blends, it was necessary in the prior art to pretreat the fibres with chemicals such as technical grade hexamethoxymethyl melamine to render them receptive to such techniques.

With the present pretreatment methods, only papers printed with sublimable disperse dyestuffs, e.g. disperse dyestuffs which start to sublime already at temperatures as low as 160° C. could generally be used.

Naturally, this pretreatment involves additional processing and costs and the risk of errors in such pretreatment causing damage to fabric and additional costs.

The principal object of this invention is to provide a method of transfer printing which will avoid the necessity to pretreat the fibres.

Another object of the invention is to enable the use of all types of disperse dyestuffs. Even high energy, high molecular weight disperse dyestuffs will transfer.

Yet another object of the invention is to obtain a transfer printed fabric of natural or natural/synthetic blend fibres e.g., cotton, rayon or mixtures thereof with synthetic fibres with superior handle, fastness and colour yield properties, in combination.

According to one aspect of the present invention, there is provided a method of transfer printing natural or natural/synthetic blend fibres without pretreatment thereof, comprising applying to a temporary support e.g. a paper sheet or roll a disperse dyestuff and an aqueous dispersion of a transfer agent selected from the group consisting of:

(1) polyurethane powders, with or without curing agents;
(2) copolyester powders with or without curing agents;
(3) polyamide and copolyamide powders; and
(4) mixtures thereof, drying said support and transfer printing said support in a manner known in the art.

According to another aspect of the invention, there is provided a method of printing and/or coating a temporary support e.g. a paper sheet or roll for use in transfer printing of natural or natural/synthetic blend fibres without pretreatment thereof, comprising printing and/or coating said temporary support with disperse dyestuffs or an aqueous dispersion of a transfer agent selected from the group consisting of:

(1) polyurethane powders, with or without curing agents;
(2) copolyester powders, with or without curing agents;
(3) polyamide and copolyamide powders; and
(4) mixtures thereof.

The treatment of the temporary support e.g. paper sheet or roll, in accordance with the invention, may be effected by first coating the support with the transfer agent and then printing said support with said dyestuff and optionally applying a further coating of said agent. Alternatively, the dyestuffs may be first printed on the support, followed by coating of the printed support with the transfer agent.

As a further alternative, the support may first be coated by the transfer agent, followed by printing thereon of a print paste comprising the disperse dyestuffs in admixture with said agent. The so printed support may be treated with an additional coating of the transfer agent. As a further, and preferred alternative, the above print paste (containing disperse dyestuffs and transfer agent) may simply be printed directly onto the uncoated support.

The application of the above transfer agent and dyestuffs can be by way of coating, printing or both techniques. Printing can be by any conventional printing technique to suit the support such as roto gravure, offset, letter-press, stencil, etc., or on rotary screen printing machines; also manually by using screen printing techniques. The preferred method of printing is (a) by engraved, offset or roller printing e.g. Itaglio or (b) using a converted or specially manufactured textile screen printing machine suitable for paper printing, as above. Coating can be carried out using knife-over-roller, air knife and other conventional paper coating techniques; a popular method is to use a sheet fed flat bed screen coating machine, or for paper rolls a specially built or converted textile, rotary screen coating and printing machine.

Preferably, the transfer agent is a polyurethane powder (with or without a curing agent), one of which is marketed under the trademark Acrytex (trademark of Dulux). Another very suitable polyurethane powder is marketed by Ferro Corporation U.S.A. under the Tradename of VEDOC VP Clear Polyurethane Powder (Specific Gravity 1.25). For technical description and properties see their Application Leaflet 3M Jan. 1980 IL. A further suitable polymer is the co-polyester Griltex* 6P and to a lesser degree Griltex* 8P. Copolyamides of low fusion temperatures can be used, e.g. co-polyamides of polyamide (Nylon) 6 (caprolactam), polyamide (Nylon) 6.6 (hexamethylenediamine adipate) and polyamide (Nylon) 6.10 (hexamethylene sebacate) such as manufactured by Rhodiaceta and DuPont, under the trade names Technyls and Zytel, respectively. Preferred are co-polyamides 6/6.6/12 as manufactured by EMS-Chemie AG, Switzerland, by a patented process, from caprolactam, hexamethylenediamine adipate and lauryl lactam under the trade names of Griltex 1P, 2P, 4P and 5P, but preferably 2P, because of its excellent resistance to laundering.

* Registered trademark of EMS-Chemie AG, Zurich, Switzerland.

Advantageously, up to 20g/kg (or parts /1000), preferably 15g/kg (or parts /1000) of technical at room temperature, water insoluble, or partly or sparingly soluble molecular and polymolecular (polycondensed) hexamethoxymethyl melamine mixtures in equilibrium with its reaction components (hereinafter referred to as HMMH) may be incorporated in the transfer agent or in the print paste referred to above.

As is well known, pure hexamethoxymethyl melamine is a water soluble substance. To render the melamine water insoluble, or partly or sparingly soluble, it is slightly self-condensed. The production of this condensed compound is well known and is generally as follows:

Melamine is reacted with formaldehyde and acetylated with methanol In the presence of acid catalysts and in the absence of other functional groups with which it would otherwise react in preference, it condenses with itself. Such a product is termed "technical" hexamethoxymethyl melamine and is commercially available. Generally, these mixtures comprises 50 to 70% by weight hexamethoxymethyl melamine and also contain its condensation products of 2 to 3 and up to 6 molecules of pre-condensed melamine For instance, a typical mixture may contain about 60% by weight hexamethoxymethyl melamine, about 13% by weight of 2 to 4 molecular condensate and about 26% of the 6 molecular condensate (e.g. Luvipal 066*) or Cymel 303**.

* Registered trademark of BASF Aktiengesellschaft West Germany
** Registered trademark of American Cyanamid Co. U.S.A.

The incorporation of the HMMM significantly improves the washfastness of the resultant printed fabrics when tested according to the International Standard Organisation Test No. IS03 which is a severe wash test, particularly on 100% cotton or other cellulosics; since cellulosics have not a natural affinity for disperse dyes and since the polyurethane and the HMMM, both in combination and separately, provide additional dye sites, these being cationic, they attract and bind the disperse dyes.

The transfer agent may advantageously include conventional components used for coating and/or printing of the support, e.g. thickening agents, such as homopolymers of acrylic acid (approx. molecular weight 4 million) or co-polymers of acrylic acid and acrylamide, cross-linking agents, handle modifiers and lubricants, such as primary and secondary dispersions of polyethylene waxes (approx. molecular weight below 20,000). Another useful addition is polyvinyl chloride or polyvinylidene chloride emulsions or their organic esters. The wet and rubfastness properties are improved thereby, but the resulting handle of the printed fabric is not quite as soft as without this addition.

The transfer temperatures will depend on the type of fabric transfer printed and the transfer time in the press. Conveniently, the temperature range can be 180o to 220° C. for the cellulosic blends and 190° to 230° C. for the 100% cellulosic fibre fabrics, respectively. Preferred temperatures and times are (a) 200° C. for 30 seconds for polyester/cotton and other cellulosic mixtures with synthetic fibre fabrics, provided the proportion of synthetic fibre in the blend is at least 50% by weight, and (b) 205° C. for 35 seconds for 100% cotton or other cellulosic fibres and their blends with synthetic fibres, where the latter constitute less than 50% by weight of the blend.

The transfer duration is not critical provided the minimum time of 25 seconds for the cellulosic fibre containing blends, and 30 seconds for the 100% cellulosic fibre fabrics, respectively, are achieved.

Whilst sublimable disperse dyestuffs would be preferred from a yield point of view, high energy or sublimation fast disperse dyestuffs give on average better wet and heat fastness properties, e.g. they resist wet processes such as washing, immersion in sea water and perspiration better than sublimable dyestuffs. Similarly, they resist further exposure to heat, up to the transfer temperatures, better than the sublimable dyestuffs.

In practice, and according to a preferred embodiment of the invention, the polymer powders and other additives are stirred into water at room temperature, preferably with the aid of a high speed stirrer (1000 to 3000 rpm), and are made up to the required concentration with water. The coating or printing composition so formed is then applied to the supporting web e.g. paper sheet or roll by methods already described. One method is to use a converted textile rotary screen printing machine where the first screen (60 mesh) is used to coat the transfer agent on to the paper and subsequent screens containing the printing colours (of various mesh sizes depending on design) are used to print the so treated paper. The preferred method, as already mentioned, is to apply the disperse dyestuffs and transfer agent together from the same screens or rollers. The art of printing paper and other supporting webs with disperse dyestuffs is well known.

Preferred embodiments of the invention will now be described in the following non-limiting examples.

EXAMPLE 1

Into approximately not more than 640cc's of water at room temperature (20° C.), was stirred (see general method above at 2800 RPM, the following ingredients in the following order:

245 grams polyurethane powder e.g. Acrytex *
40 grams CAS Number 26100-47-0 thickener e.g. Lutexal HP*
15 grams of HMMM e.g. Luvipal 066***

* Manufactured by Dulux a division of ICI ANZ
** Chemical Abstracts System for identification of Chemicals
*** Registered trademark of BASF Aktiengesellschaft The paste was adjusted to 940 grams by adding a small amount of water and re-stirring. After 5 minutes stirring a smooth homogeneous dispersion of essentially polyurethane powder in water was obtained. This dispersion has the appearance and properties of a homogeneous paste and is suitable for coating on paper sheets or rolls or another temporary support web.

EXAMPLE 2

Using the colourless paste prepared in EXAMPLE 1 seven coloured print pastes were prepared, by adding the colours last to the composition after a smooth paste had already been obtained, by stirring for 5 minutes. The total coloured print pastes composition was then, as shown in the next table:

| grams | 1 | 2 | 3 | 4 | 5 | 6 | 7[1] |
|---|---|---|---|---|---|---|---|
| Water | 640 | 640 | 640 | 640 | 640 | 640 | 575 |
| Dulux polyurethane clear pds* | 245 | 245 | 245 | 245 | 245 | 245 | 250 |
| Lutexal HP** HMMM | 40 | 40 | 40 | 40 | 40 | 40 | 40 |
| Luvipal 066** | 15 | 15 | 15 | 15 | 15 | 15 | 15 |
| [a2]CI Disperse Red 60 Bafixan** Red BF | 60 | | | | | | |
| [b]CI Disperse Blue 326 Bafixan Blue R | | 60 | | | | | |
| [c]CI Disperse Yellow 54 Bafixan yellow 3GE | | | 60 | | | | |
| [d]CI Disperse Blue 72 Bafixan** Blue 2RL | | | | 60 | | | |
| [e]CI Disperse Red 92 Palanil** Br. Red P-BEL | | | | | 60 | | |
| [f]CI Disperse Blue 94 Palanil Navy Blue RE | | | | | | 60 | |
| [g]Palanil Black P-GEL*** Mixture based on | | | | | | | 120 |

-continued

| grams | 1 | 2 | 3 | 4 | 5 | 6 | 7[1] |
|---|---|---|---|---|---|---|---|
| Disperse Blue 94 | | | | | | | |

Note:
*a to d* are examples of sublimable disperse dyes;
*e to g* are examples of high energy e.g. high sublimation fast disperse dyes.
[1]Paste prepared separately according to method of Example 1.
[2]CI means Colour Index Numbers as published for the indentification of Dyestuffs by the American Association of Textile Chemists and Colourists of North Carolina, U.S.A. and the Society of Dyers and Colour ists of Bradford, England. By means of the "Colour Index" published by the above organisations most colouring matter can be identified as to type, fastness properties and chemical constitution. The Colour-Index Numbers liosted in the Application were obtained from the - Technical Information Bulletin No: TI/T0 29d March 1988, entitled: "Colour-Index Nummern der Textil-Farbstoffe" and published by BASF Aktiengesellschaft of West Germany.
*Polyurethane powders without any pigmentation e.g. clear, such as Acrytex
**Registered trademark of BASF Aktiengesellschaft
***This paste was prepared separately.

EXAMPLE 3

As in Examples 1 and 2, a similar paste for coating was prepared, except that the amount of polyurethane powder was increased to 300gms/kg; and the water content reduced accordingly to 585gms/kg coating paste, for all colours except Palanil Black P-GEL; for which the polyurethane powder was increased to 350 gms/kg and the water reduced to 475gms/kg.

EXAMPLE 4

The pastes from Example 3 were charged with colour in the same way as in Example 2; whereas the corresponding pastes 1–6 contained the disperse dyestuffs (a)–(f) respectively; and whereas they all contained 300grams/ of polyurethane powder, per 1000 grams total weight, except paste 7 (Palanil Black P-GEL), which contained 350 grams of polyurethane powder, per 1000 grams of printpaste. The seven printpastes from Examples 2 and 4 respectively were adjusted for viscosity between 20 and 30 poise as measured with the Haake-Viskotester and were printed on standard paper suitable for transfer printing (see Example 7), through a 24 mesh (metric) screen on a Johannes Zimmer magnetic table printing machine, using a 12 mm roller and pressure setting No. 3. After flooding the screen in one pass, with the printpaste (screen raised), printing was completed in another pass of the magnetic roller, with the screen in contact with the paper The paper was dried at 120° C to 150° C. This method describes a well known "state of art" or conventional process for the printing of paper with disperse dyes, intended for subsequent transferring onto textile fabrics. Other well known processes are described in the Process Data Sheet of BASF Aktiengesellschaft entitled "Bafixan Dyes in Transfer Printing". No. 139e - 08.84 (AJM).

EXAMPLE 5

The aforementioned general method was used to obtain a another paste for coating papers to be printed with disperse dyestuffs. The components for the paste were as follows:

| | |
|---|---|
| Water | 750 gms |
| CAS** Number 26100-47-0 thickener e.g. Lutexal* HP | 30 gms |
| Secondary Polyethylene Dispersion; Handle Modifier e.g. Perapret* PE 2/40 | 20 gms |
| Polyurethane Powder e.g. Acrytex*** | 200 gms |
| | 1000 gms |

*Registered Trade Mark of BASF Aktiengesellschaft
**Chemical Abstracts System for Identification of chemicals
***Manufactured by Dulux Australia, a Div. of ICI ANZ The paste was prepared as follows. Polyurethane powder at room temperature was stirred into an amount of water slightly less than specified above. Lutexal HP and Perapret PE 2/40 was then added. After stirring with a high speed stirrer between 1500 rpm and 2800 rpm, a smooth homogeneous paste of viscosity was obtained in approximately 5 minutes. The paste was made ready for coating by adjusting with water to the required weight and further stirring.

EXAMPLE 6

Using similar procedure to Example 5, another paste for coating papers to be printed with disperse dyestuffs was prepared, with the following components:

| | |
|---|---|
| Water | 750 gms |
| Lutexal HP | 30 gms |
| Perapret Pe 2/40 | 20 gms |
| Polyurethane Powder (as in Example 1) | 150 gms |
| Polyester Powder (VEDOC***-VP-218A-Lighting White Polyester Powder) | 50 gms |
| | 1000 gms |

***Manufactured by Ferro Corporation U.S.A. No. 1393 - 08.84 (AJM)

EXAMPLE 7

Using again the same method as in Examples 5 and 6, a smooth paste for coating papers to be printed with sublimable dyestuffs was prepared with the following components:

| | |
|---|---|
| Water | 750 gms |
| Lutexal HP | 30 gms |
| Perapret PE 2/40 | 20 gms |
| Polyurethane Powder (VEDOC***-VP-180 Clear Polyurethane Powder) | 140 gms |
| Copolyamide of PA 6/6.6/12 Powder e.g. Griltex* 2P | 60 gms |
| | 1000 gms |

***Manufactured by Ferro Corporation U.S.A. No. 139e - 8.84 (AJM)
*Registered Trademark of EMS-Chemie AG, Switzerland Each paste as described in Examples 1, 3, 5, 6 and 7 was coated on standard paper suitable for transfer printing, e.g. approx. weight at 70 grams per square meter (gms/m$^2$), of level appearance, with high cellulose fibre content and somewhat absorbent. The coating was achieved on a sheet fed, screen paper coating machine.

After coating and drying at 125° C., the paper was printed, as in example 4, using print pastes as described above in the already mentioned leaflet "Bafixan Dyes in Transfer Printing" (item 1.2.2.) and utilising designs containing the following colours:

| | |
|---|---|
| CI* Disperse Red 60 e.g. Bafixan Red BF | (app. 60 g/kg) |
| CI Yellow 54 e.g. Bafixan Yellow 3GE | (app. 60 g/kg) |
| CI Blue 236 e.g. Bafixan Blue R | (app. 60 g/kg) |
| CI Blue 72 e.g. Bafixan Blue 2RL | (app. 60 g/kg) |
| CI Disperse Red 92 e.g. Palanil** Br.Red P-BEL | (app. 60 g/kg) |
| CI Disperse Blue 94 e.g.Palanil** Navy Blue RE | (app. 60 g/kg) |

Please note that the print pastes did not contain any polymer powders, only the underlying coat.

Transferring: All printed designs from Examples 1–7; after printing and drying were transfered from the paper onto woven, knitted and even raised fabrics composed of 65/35 polyester/cotton, 65/35 polyester/-rayon, 50/50 polyester/cotton, 100% cotton, 80/20 Lycra/cotton and 15/70/15 nylon/Lycra/cotton fabrics, respectively by placing the fabrics and the paper together in a transfer press and applying heat at 185° to 210° C. for thirty seconds (this method is well known to those skilled in the art and is fully described in the aforementioned Bafixan publication). Results: Quite bright and intense colour designs were obtained. Brighter and more intense colour designs on cotton and predominantly cellulosic fibre containing fabrics were obtained when transferred at 205° C. compared to 200° C. and lower temperatures. The wash fastness properties on 100% cotton fabrics were half to one note better on a scale 1 to 5 (where 1 is the worst and 5 is the best), with paste from Example 3 compared to 1, 5, 6 and 7, respectively. The rub fastness was good to very good; the wet fastness properties were good to very good and the light fastness properties were acceptable to good in all cases. The handle was softer in all cases, compared to previously known processes, including the process described in the Australian Patent Application Number PH 06423.

Generally, the results would be quite acceptable commercially, in all industrialized countries, with regard to brilliance, colour yield, handle and fastness properties.

EXAMPLE 8

The following four print pastes were prepared as in Examples 2 and 4, by adding the colours last to the composition, after a smooth paste had already been obtained by stirring for 5 minutes.

| | 1 | 2 | 3 | 4 |
|---|---|---|---|---|
| Water | 708 | 708 | 708 | 708 |
| Kurofan* DS-2093 | 60 | 60 | 60 | 60 |
| Dulux Polyurethane Clear Pds** | 140 | 140 | 140 | 140 |
| CI Disperse Red 60 Bafixan Red BF | 60 | — | — | — |
| CI Disperse Yellow 181; Bafixan Yellow RL | — | 60 | — | — |
| CI Disperse Blue 376 Bafixan Blue R | — | — | 60 | — |
| CI Disperse Blue 72 Bafixan Blue 2RL | — | — | — | 60 |
| Lutexal HP | 32 | 32 | 32 | 32 |

*Vinylidene Chloride Acrylic Acid Ester, 50% emulsion (Registered Trademark of BASF Aktiengesellschaft)

**Polyurethane powders without any pigmentation, e.g. clear.

The four pastes were printed on standard paper, in the same manner as the pastes in Examples 2 and 4. Transferring was effected at 200° C. for 30 seconds on the same fabrics as in Example 7.

Result: Very good to excellent rub fastness, excellent wet fastness properties and acceptable to good light fastness properties were obtained, and the resultant handle of the different fabrics were not quite as soft as in Examples 1–7, which did not contain the addition of Vinylidene Chloride Acrylic Acid Ester.

EXAMPLE 9

Preparation of a colourant, suitable for printing onto paper for subsequent transfer printing onto textiles, composed of 100% cellulosic or cellulosic mixtures with polyester and other synthetic fibres, without these fabrics being previously pretreated with chemicals, which normally would make them accept sublimable dispersed dyestuffs.

Into 550 gms of an aqueous dispersion of CI Disperse Blue 72 (Bafixan Blue 2RL), was stirred, at 1000 rpm, 450 gms of polyurethane powder (Acrytex) at room temperature. This colour was thus made ready for addition to print pastes, suitable for printing onto paper, by conventional methods (see Examples 2, 4 and 8).

This colourant has provisionally been called Transferol Blue RD.

EXAMPLE 10

A printpaste was prepared, by stirring into approximately 665 grams of water at room temperature 20° C.) and using a variable speed stirrer; MAKE WALDON, set at 1800 RPM, 300 grams of Transferol Blue RD (Example 9), followed by 35 grams of Lutexal HP, until a smooth homogeneous paste was obtained. The preparation was adjusted to 1000 grams, by adding a small amount of water. Its viscosity at 20° C. was measured as being 22 poise, with the Haake-Viskotester. This print paste was applied to the above fabrics and by the same method as outlined in Example 8.

A deep, fast to washing and rubbing, blue was obtained.

Summary: The above Examples 1–10 illustrate:

There are no chemical or physical differences between the pastes used for coating and those used for printing. The latter usually contains colour but both may contain colour or both may be colourless.

For example, fashionable designs may be produced, by printing onto the temporary support, colourless pastes containing the Transfer Agent and subsequently overprinting with colours, but without the Transfer Agent. After transferring these designs, the parts not covered by Transfer Agent will substantially wash out, giving fashionable colour tones.

The process sequence may be coat, dry, print, dry, transfer or coat, dry, print, dry, coat, dry, transfer or print, dry, coat, dry, transfer or print, dry, transfer or any combination of coating and/or printing.

A printing machine or hand screen can also be used for coating.

General Results:

Compared to the Bafixan process (see above) and other previously published methods, the examples have illustrated the following general advantageous results.

Advantages.

Increased light, wet and dry cleaning fastness properties.

Colour yield is increased; therefore, dyestuff savings.

The handle obtained is softer.

The drying temperature of the printed paper is not critical, e.g. higher temperatures than 110° C. can be utilized (normally about 150° C.); this leads to higher production speeds.

The colour yield is independent of the hot-air flow during drying of the papers, e.g. no migration and, therefore, simpler, less costly machines can be used.

The fabrics can be transfer printed from any side, since the penetration is excellent; this widens the scope of the process, e.g. uniformly dyed, or special weave imitation textile fabrics can be produced.

No catalysts are required, therefore, cost saving and avoidance of undesirable side effects.

Together with brilliance of shade and superior fastness properties obtained on both cotton and other cellulosic fibres and cellulosic fibre blends with synthetics, the textile character and handle of the fabrics is practically unimpaired.

The fastness properties obtainable depend largely on the amount of polymer powders applied and fibre blends employed which in turn will influence the economy of the process. Accordingly, these methods would be best suited for the economic production of high quality textiles.

Similarities

Wide application to different textile fabrics, e.g. 100% cotton, polyester/cotton, 100% rayon, polyester/rayon; polyamide/cotton, polyamide/rayon, elastomeric fibres, such as Lycra and mixtures thereof with other natural and or synthetic fibres; wool, polyester/-wool, polyamide/wool, polyacrylonitrile and various mixtures thereof with other fibres; polyamide and various mixtures thereof with other fibres.

Disadvantages

None known.

Definitions

Whilst the various terms mentioned are well known to those skilled in the art of converting loom state woven or knitted textile cloths to finished textile fabrics, an attempt has been made here to explain some of the specific terms used, in an abbreviated and by no means limiting form:

Fastness properties normally means resistance to certain chemical and/or physical influences, encountered during processing, testing or using the textiles. The International Standards Organisation (ISO) in Paris, France, has issued standard methods for the testing of textiles including their fastness ratings.

Lightfastness for example is rated on a scale of 1 to 8, where 1 is the worst and 8 the best; other fastnes properties such as resistance to rubbing, wet treatments (washing, immersion in fresh or salt water and perspiration) are similarly measured on a scale of 1 to 5; 5 being the best.

Most industrial countries have developed their own test standards but normally based on the ISO norms.

In Australia, we have largely used the fastness or performance test methods and standards (based on ISO), as published by STANDARDS ASSOCIATION OF AUSTRALIA. (Because of the severe extremities of the Australian climate, the fastness requirements are generally high and this is reflected in the test methods).

Colour Yield means the relative intensity of colour developed during a process by a fixed molar amount or weight of chromophore particles.

Handle means the way in which a textile fabric or garment feels to an observer or user handling it, e.g. soft, firm, harsh, stiff etc. This is a purely subjective test.

Brilliance or Brightness means the reflectance of a colour, as perceived by the human eye, or as measured by an instrument.

Coating means applying coloured or colourless pastes uniformally to one or both sides of textile fabrics.

Printing means applying coloured or colourless images in paste form to usually one side of textile fabrics. If the image is applied uniformally across the total area of the side, printing becomes synonymous with coating.

Transfer Printing means printing the images first on a different substrate or temporary web, such as paper, and then placing such support in close contact with the fibre substrate, such as the textile material, transferring the image from the support to the textile fibre, by the application of heat.

(In this Application the polymer powder melts and transfers into the textile fibres, together with the chemically and physically bound disperse dyestuff).

We claim:

1. A method of transfer printing an image onto natural or natural/synthetic blend fibres comprising the steps of:

(a) applying a disperse dyestuff in the form of an image to a temporary support, and applying a transfer agent comprising an aqueous dispersion of a powder selected from the group consisting of:
(1) a polyurethane powder;
(2) a copolyester powder;
(3) a polyamide powder;
(4) a copolyamide powder; and
(5) mixtures thereof
to the temporary support, thereby forming a dyestuff image- and transfer agent-carrying support;

(b) drying the dyestuff image- and transfer agent-carrying support to form a dried support; and (c) transferring the dyestuff image and the transfer agent together from the dried support onto the fibres.

2. The method of claim 1 wherein step (c) is carried out at a temperature between 180° C. and 230° C.

3. The method of claim 2 wherein the duration of step (c) is at least 25 seconds.

4. The method of claim 1 wherein in step (a) the transfer agent is first applied to the temporary support by coating, then the dyestuff image is applied to the temporary support.

5. The method of claim 4 wherein after step (a) a second coating of the transfer agent is applied.

6. The method of claim 1 wherein in step (a) the dyestuff is applied to the temporary support first, then the transfer agent is applied to the temporary support by coating.

7. The method of claim 1 wherein in step (a) the dyestuff is admixed with the transfer agent to form a print paste, and then the print paste is applied to the temporary support.

8. The method of claim 7 wherein before step (a) a coating of the transfer agent is applied to the temporary support.

9. The method of claim 7 wherein after step (a) and before step (b) a coating of the transfer agent is applied to the support.

10. The method of claim 1 wherein the transfer agent powder is a polyurethane powder.

11. The method of claim 10 wherein the transfer agent additionally comprise a curing agent.

12. The method of claim 1 wherein the transfer agent powder is a copolyester powder.

13. The method of claim 12 wherein the transfer agent additionally comprises a curing agent.

14. The method of claim 1 wherein the transfer agent power is a polyamide powder.

15. The method of claim 1 wherein the transfer agent powder is a copolyamide powder.

16. The method of claim 1 wherein the transfer agent further comprises up to 20 g/kg of a washfastness improving agent comprising technical hexamethoxymethyl melamine.

17. The method of claim 1 wherein the transfer agent further comprises a wet and rubfastness improving agent comprising polyvinyl chloride or polyvinylidene chloride.

18. Transfer printed natural or natural/synthetic blend fibres produced according to the method of claim 1.

19. A dried support for printing onto natural or natural/synthetic fibres comprising:

(a) a temporary support having a top surface;

(b) a disperse dyestuff applied in the form of an image on the top surface; and (c) a transfer agent comprising a powder selected from the group consisting of:

(1) a polyurethane powder;

(2) a copolyester powder;

(3) a polyamide powder;

(4) a copolyamide powder; and (5) mixtures thereof also applied on the top surface so that when the dried support is used in transfer printing the dyestuff image and the transfer agent are tandemly transferred to the fibres.

20. The dried support of claim 19 wherein the transfer agent is present as a layer between the top surface and the dyestuff image.

21. The dried support of claim 19 wherein the transfer agent is present as a layer on the top surface on top of the dyestuff image.

22. The dried support of claim 19 wherein the dyestuff and the transfer agent are admixed into a print paste and present on the top surface as such.

23. The dried support of claim 22 further comprising a layer of transfer agent between the top surface and the print paste.

24. The dried support of claim 19 wherein the transfer agent further comprises up to 20 g/kg of a washfastness improving agent comprising technical hexamethoxymethyl melamine.

25. The dried support of claim 19 wherein the transfer agent further comprises a wet and rubfastness improving agent comprising polyvinyl chloride or polyvinylidene chloride.

* * * * *